US006109291A

United States Patent [19]

Yoshimura

[11] Patent Number: 6,109,291

[45] **Date of Patent: *Aug. 29, 2000**

[54] PILOT 5-PORT TRANSFER VALVE

[75] Inventor: Shinichi Yoshimura, Yawara-mura, Japan

[73] Assignee: SMC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/947,825

[22] Filed: Oct. 8, 1997

[30] Foreign Application Priority Data

Oct. 28, 1996 [JP] Japan ..... 8-302558

[51] Int. Cl.[7] ..... F15B 13/043

[52] U.S. Cl. ..... 137/269; 137/625.64; 137/854; 251/26

[58] Field of Search ..... 137/269, 625.64, 137/854; 251/26

[56] References Cited

U.S. PATENT DOCUMENTS

| | | | |
|---|---|---|---|
| 4,257,572 | 3/1981 | Neff | 137/625.64 X |
| 4,267,862 | 5/1981 | Neff et al. | 137/625.64 |
| 4,649,957 | 3/1987 | Quinn | 137/625.64 |
| 4,966,196 | 10/1990 | Meyer | 137/635.64 |
| 5,400,821 | 3/1995 | Ott | 137/854 X |
| 5,615,710 | 4/1997 | Sato | 137/625.64 |

FOREIGN PATENT DOCUMENTS

| | | |
|---|---|---|
| 590 339 A1 | 6/1994 | European Pat. Off. . |
| 2 315 653 | 1/1977 | France . |

OTHER PUBLICATIONS

Patent abstracts of Japan: vol. 010, no. 218 (M–503), Jul. 30, 1986.

*Primary Examiner*—Gerald A. Michalsky
*Attorney, Agent, or Firm*—Oblon, Spivak, McClelland, Maier & Neustadt, P.C.

[57] ABSTRACT

A transfer valve comprising a first port 17 for supplying and ejecting a pressurized fluid, a second and third ports 18 and 19 for output, and a fourth and fifth ports 20 and 21 for ejection and supply includes a pilot supply channel 24 for supplying a pilot fluid to a pilot valve 13. The pilot supply channel 24 is connected to the first, fourth, and fifth ports 17, 20, and 21 via check valves 38*a*, 38*b*, and 38*c*, respectively.

7 Claims, 6 Drawing Sheets

PILOT 5-PORT TRANSFER VALVE

FIELD OF THE INVENTION

The present invention relates to a pilot 5-port transfer valve that switches a 5-port main valve using a pilot valve.

PRIOR ART

FIG. 9 shows a publicly known pilot 5-port transfer valve wherein a transfer valve 1 comprises a 5-port main valve 2 and a solenoid-driven pilot valve 3. The main valve 2 includes a supply port P that is connected to a supply source for a pressurized fluid such as compressed air; output ports A and B that are connected to an actuator; ejection ports EA and EB that are externally open; and a main valve member (not shown) that is operated by a pilot fluid pressure to connect the output ports A and B to the supply port P or the ejection ports EA and EB. In addition, the pilot valve 3 includes a pilot supply port (p); a pilot output port (a); a pilot ejection port (r); and a pilot valve member (not shown) that is driven by a solenoid 4 to connect the pilot output port (a) to the pilot supply port (p) or the pilot ejection port (r).

When the solenoid 4 of the pilot valve 3 is energized, the transfer valve 1 switches the pilot valve 3 to a position opposed to that shown in the figure, in order to allow pilot fluid to be output to the main valve 2 from the pilot output port (a), thereby switching the valve member of the main valve 2 to allow the supply port P to communicate with the output port A while allowing the output port B to communicate with the ejection port EB. As a result, a pressurized fluid is output from the output port A.

When the solenoid 4 is de-energized, the pilot valve 3 returns to the switching position shown in the figure to externally eject the pilot fluid supplied to the main valve 2, from the pilot ejection port(r). Thus, the urging force of a return spring 5 causes the valve member of the main valve 2 to return, allowing the supply port P to communicate with the output port B and the output port A to communicate with the ejection port EA. As a result, a pressurized fluid is output from the output port B.

The pilot 5-port transfer valve 1 is classified into an internal and external pilot type based on the method for supplying a pilot fluid to the pilot valve 3. In the internal pilot transfer valve, pilot fluid is supplied from the supply port P of the main valve 2 through a channel provided in the valve body to the pilot supply port (p) of the pilot valve 3, whereas in the external pilot transfer valve, pilot fluid is supplied to the pilot supply port (p) through an external piping connected to the pilot valve.

The pilot 5-port transfer valve 1 is also classified into a central supply type, in which pressurized fluid is supplied from the central port P, and a dual-end supply type, in which pressurized fluid is supplied using the ports EA and EB on both sides as supply ports while the central port P is used as an ejection port.

The pilot 5-port transfer valve thus involves various types and the different types of valves are used for different applications. Since, however, most of these valves are mutually incompatible, the respective types have been required to be individually provided and used, so many types of transfer valves have been manufactured, resulting in very cumbersome manufacturing and product control.

In particular, if the transfer valve is of an external pilot type, a pilot fluid is supplied to the pilot valve 3 through external piping. Thus, this type of transfer valve can be changed between the central and the dual-end supply types by connecting either the port P of the main valve 2 or the ports EA and EB on both sides to the supply source for pressurized fluid. In the internal pilot transfer valve, however, even when the ports EA and EB are connected to the supply source for pressurized fluid, the transfer valve cannot be changed between the central supply type and the dual-end supply type; instead, both types must be separately provided because pilot fluid is not supplied from the ports EA and EB.

DISCLOSURE OF THE INVENTION

It is a main object of this invention to provide a pilot 5-port transfer valve that can be changed between the central supply and dual-end supply types even if it is an internal pilot type.

It is another object of this invention to enable the pilot 5-port transfer valve to be used as either an internal pilot or external pilot type.

To achieve these objectives, this invention provides a pilot 5-port transfer valve that includes a first port for supplying and ejecting a pressurized fluid; second and third ports for output; and fourth and fifth ports for ejection or supply, wherein the pilot valve includes a pilot supply channel for supplying a pilot fluid to the pilot valve and wherein a check valve that allows the flow of a pressurized fluid into the pilot supply channel from each port while checking the flow of a pressurized fluid in the opposite direction is installed between the pilot supply channel and each of the first, the fourth, and the fifth ports.

Due to its ability to supply a pilot fluid from any of the first, the fourth, and the fifth ports through the check valve to the pilot valve, the transfer valve of the above configuration can be used as the central supply type if the first port is connected to a supply source for pressurized fluid and as the dual-end supply type if the fourth and the fifth ports are connected to the supply source for pressurized fluid.

According to a specific embodiment, each check valve is constituted by attaching to the valve body a lip seal that is directional, or by using a poppet valve and a valve spring that urges the valve body in the direction in which it contacts a valve seat.

According to a preferred embodiment of this invention, the transfer valve includes an external pilot port for externally introducing a pilot fluid and a check valve that allows the flow of a pressurized fluid into the pilot supply channel from the pilot port while checking the flow of a pressurized fluid in the opposite direction. The check valve is installed between the external pilot port and the pilot supply channel.

This configuration enables the transfer valve to be used as an external pilot type. If external piping is connected to the external pilot port and a pilot fluid with a higher pressure than a main fluid is supplied, the transfer valve is used as the external pilot type because the pilot fluid pushes the check valve open and is supplied to the pilot valve. In this case, the check valves corresponding to the first, the fourth, and the fifth ports prevent the highly pressurized pilot fluid from flowing back to these ports.

BREIF DESCRIPTION OF THE INVENTION

DETAILED DESCRIPTION OF THE PREFERRED EMBODIMENT

Figure 1:
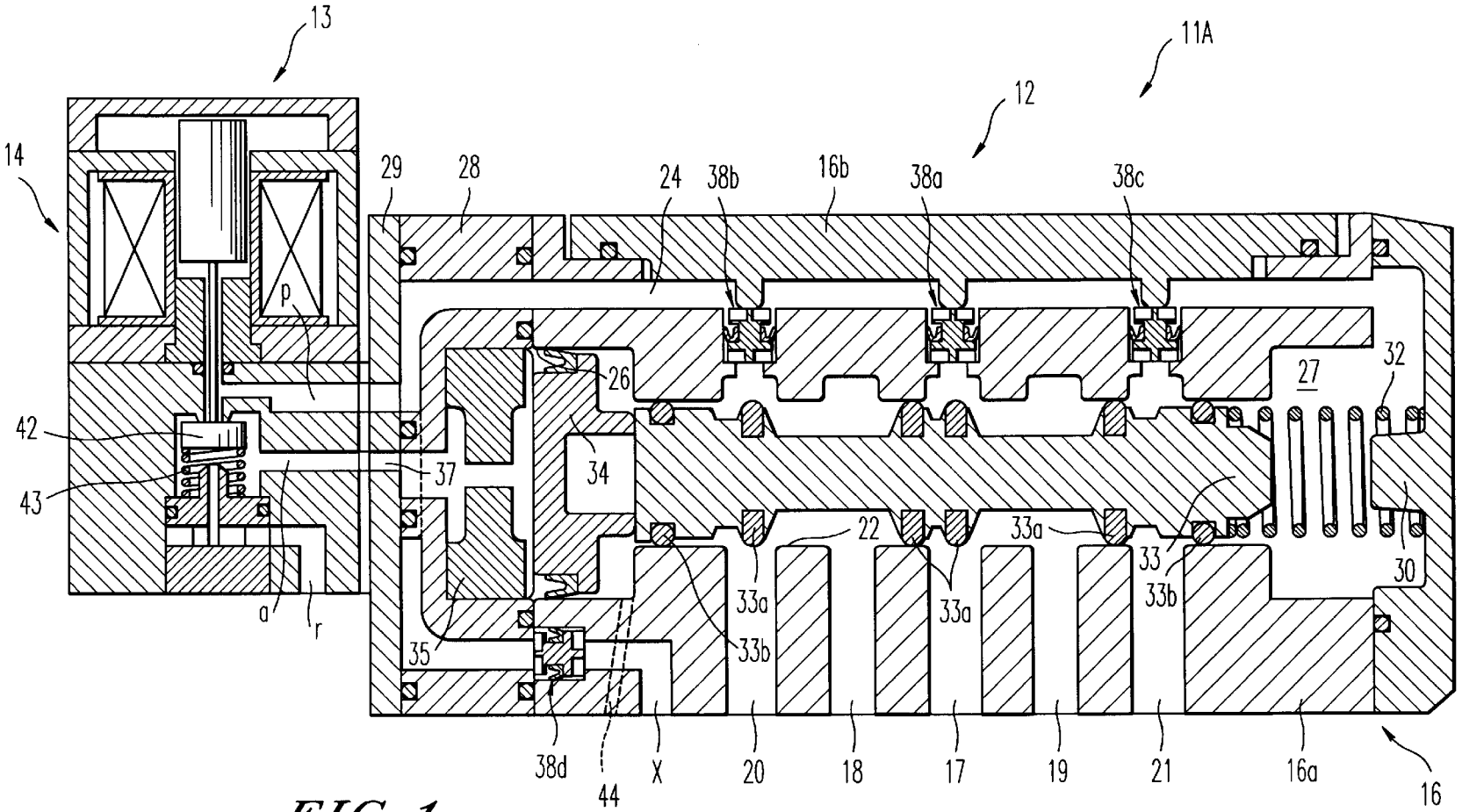
FIG. 1 is a cross sectional view showing a first embodiment of a 5-port transfer valve according to this invention.
Figure 2:
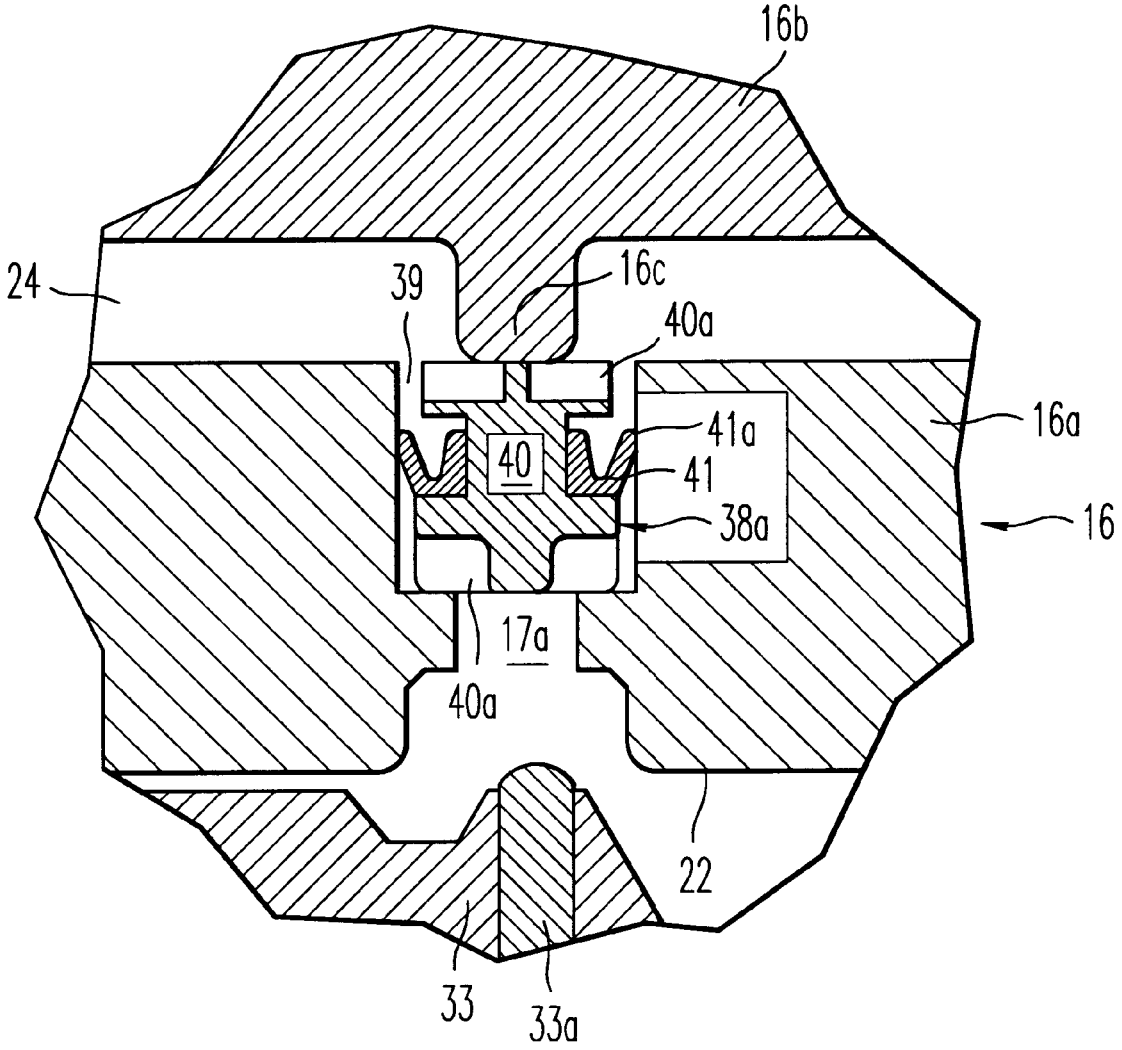
FIG. 2 is an enlarged view of the integral part of FIG. 1.
Figure 8:
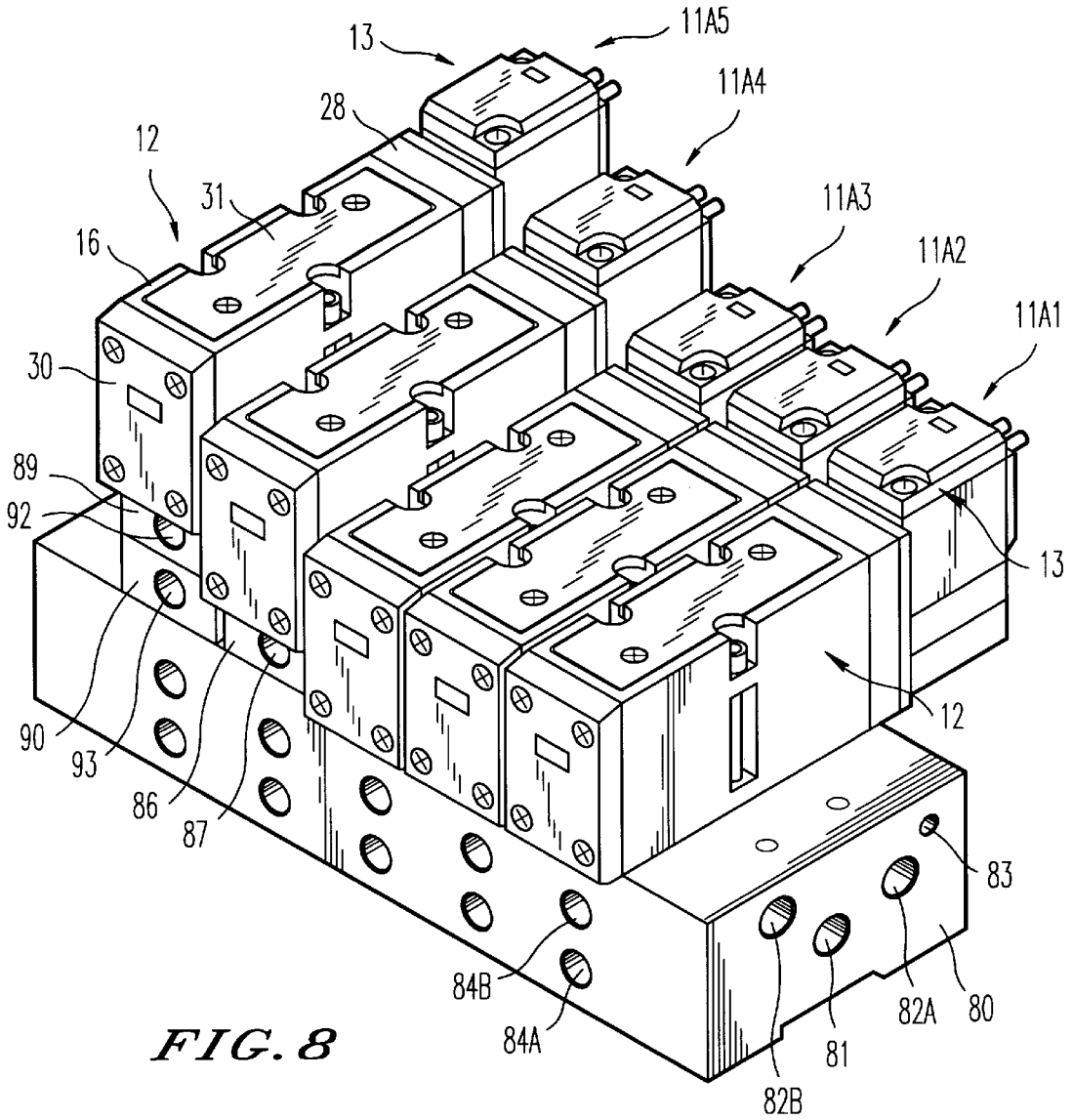
FIG. 8 is a perspective view showing a state in which the transfer valves according to this invention are collectively loaded on a manifold.
Figure 9:
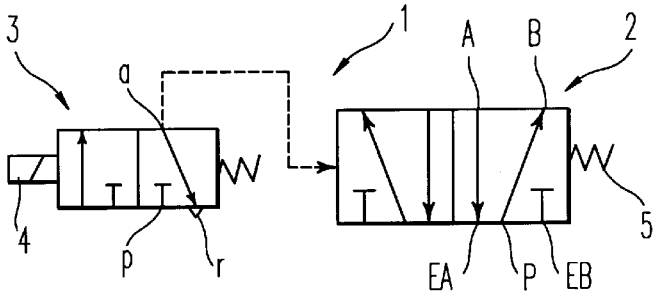
FIG. 9 PRIOR ART
FIG. 9 shows the configuration of a publicly known 5-port transfer valve using symbols.

FIGS. 1 and 2 show a single pilot 5-port transfer valve 11A comprising a main valve 12 and a solenoid-driven pilot valve 13 and configured to be installed on a manifold base 80 as shown in FIG. 8.

A valve body 16 of a main valve 12 is rectangular-parallellopiped-shaped and has a first port 17 disposed at its center, a second and a third ports 18 and 19 disposed on the respective outer sides of the first port, and a fourth and a fifth ports 20 and 21 disposed on the respective outer sides of the second and the third ports 18 and 19, all sequentially disposed in the longitudinal direction at an equal interval. The body 16 also has an external pilot port X. A valve hole 22 with which the first to the fifth ports 17 to 21 communicate is disposed inside the valve body 16, and a valve member 33 that alternatively allows the second and the third ports 18 and 19 to communicate with the first port 17 and the fourth or fifth port 20 or 21 is slidably disposed in the valve hole 22.

Seal rings 33*a* and 33*b* that block the passage between adjacent ports and O rings 33*b* and 33*b* that form a seal between the fourth port 20 and a piston chamber 26 and between the fifth port 21 and a return chamber 27 are fitted into grooves in the outer circumferential surface of the valve member 33.

The piston chamber 26 is formed under a relay box 28 at one end of the valve hole 22. A piston 34 with a larger diameter than the valve member 33 is slidably inserted into the piston chamber 26, and a cushion 35 that absorbs any impact occurring when the piston 34 moves to the left terminal is disposed inside the relay box 26.

The return chamber 27 is formed inside a presser cover 30 at the other end of the valve hole 22, and in the return chamber 27, a return spring 32 with a small urging force is contracted between the presser cover 30 and the valve member 33.

The main valve 12 has a pilot supply channel 24 that supplies a pilot fluid to the pilot valve 13 and which is in communication with the first, the fourth, and fifth ports 17, 20, and 21, with the external pilot port X via check valves 38*a*, 38*b*, 38*c*, and 38*d* and also with the return chamber 27 and a pilot supply port (p) of the pilot valve 13.

In the figure, 29 is a cover that covers the end surface of the relay box 28 and which defines part of the pilot supply channel 24 inside the relay box 28, and 16*b* is a top cover of the valve body 16 wherein part of the pilot supply channel 24 is defined and formed between the top cover 16*b* and a body portion 16*a*.

In addition, the piston chamber 26 is in communication with a pilot output port (a) of the pilot valve 13 through a pilot supply channel 37 formed in the relay box 28 and the cover 29. In the figure, 44 is a breather hole that externally opens the chamber between the rear surface of the piston 34 and the valve member 33.

The check valves 38*a*, 38*b*, 38*c*, and 38*d* each allow pressurized fluid to flow from the first, fourth, and fifth ports 17, 20, and 21 and the external pilot port X to the pilot supply channel 24 but check the flow in the opposite direction. These check valves all have the same configuration which is shown specifically in FIG. 2.

FIG. 2 shows the check valve 38*a* corresponding to the first port 17. The check valve 38*a* comprises a cylindrical valve body 40 and an annular lip seal 41 mounted on the outer circumference thereof. The valve body 40 is inserted into a circular valve chamber 39 formed between a through-hole 17*a* leading to the first port 17 and the pilot supply channel 24 so as to maintain in this area a gap that acts as a channel, and the lip seal 41 includes a flexible lip 41*a* that contacts the inner wall of the valve chamber 39 and which allows pilot fluid to flow from the first port 17 to the pilot supply channel 24 while checking the flow of pilot fluid from the pilot supply channel 24 to the first port 17. In the figure, 40*a* is a channel groove radially formed in both end surfaces of the valve body 40.

In addition, the upper end of the valve body 40 on the check valve 38*a* is pressed by a protrusion 16*c*, which is integrally formed on the top cover 16*b* in order to prevent the valve body from slipping out from the valve chamber 39 due to the active force of air pressure. The check valves 38*b* and 38*c* corresponding to the fourth and fifth ports 20 and 21 similarly have their valve body 40 pressed by the protrusion 16*c* of the top cover 16*b*, but the check valve 38*d* corresponding to the external pilot port X is prevented from slipping out from the valve chamber 39 by the contact between the valve body 40 and the relay box 28. Ofcourse, the protrusion 16*c* must be sized to prevent the flow of pilot fluid through the pilot supply channel 24 from being interrupted.

The pilot valve 13 is configured as a well-known constantly-closed 3-port solenoid valve and includes the pilot supply port (p), the pilot output port (a), the pilot ejection port (r), a pilot valve member 42 that allows the pilot output port (a) to communicate with the pilot supply or ejection port (p) or (r), and a return spring 43 that urges the pilot valve member 42 in the direction in which the pilot supply port (p) is closed. When the solenoid 14 is energized, the pilot valve member 42 allows the pilot supply port (p) to communicate with the pilot output port (a), whereas when the solenoid 14 is de-energized, the force of the return spring 43 causes the pilot valve member 42 to return to the state shown in the figure, thereby allowing the pilot output port (a) to communicate with the pilot ejection port (r).

The transfer valve 11A of this configuration acts as the internal pilot type if a pilot fluid is not supplied from the external pilot port X to the pilot valve 13; otherwise, it acts as the external pilot type.

The transfer valve 11A also acts as the central supply type if the first port 17 of the main valve 12 is connected to a supply source for pressurized fluid, or as the dual-end supply type if the fourth and fifth ports 20 and 21 are connected to such a supply source.

In a first use example, if the transfer valve 11A is allowed to act as the internal pilot type, with external piping for supplying a pilot fluid remaining disconnected from the external pilot port X, and the first port 17 is connected to a supply source for pressurized fluid, the transfer valve 11A can be used as the internal pilot and central supply type. In this case, a pilot fluid is supplied from the first port 17 through the check valve 38*a* and the pilot supply channel 24 to the return chamber 27 and the pilot supply port (p) of the pilot valve 13. The pilot fluid, however, is prevented from flowing back to the fourth, the fifth, or the external pilot port 20, 21, or X due to the operation of the other check valves 38*b*, 38*c*, and 38*d*.

In this internal pilot and central supply type transfer valve, while the solenoid 14 is de-energized as shown in the figure, the active force of pilot fluid supplied to the return chamber 27 and the force of the return spring 32 cause the valve member 33 to be placed in its first switching position. At this point, the first port 17 (the supply port) and the third port 19 (the output port) are in communication with each other, while the second port 18 (the output port) and the fourth port 20 (the ejection port) are in communication with each other and while the fifth port 21 (the ejection port) is shut off from the other ports. Here, pressurized fluid is output from the third port 19.

When the solenoid 14 is energized, a pilot fluid is supplied from the pilot supply port (p) through the pilot output port (a) and the pilot output channel 37 to the piston chamber 26 of the main valve 12, thereby causing the piston 34 to move the valve member 33 to the right as seen in the figure. The transfer valve then assumes a second switching position in which the first port 17 is allowed to communicate with the second port 18, while the third port 19 is allowed to communicate with the fifth port 21 and while the fourth port is shut off from the other ports. Here, pressurized fluid is output from the second port 18.

When the solenoid is then de-energized, the pilot fluid in the piston chamber 26 is ejected from the pilot ejection port (r) through the pilot output channel 37, so the action both of the pilot fluid being supplied to the return chamber 27 and of the return spring 32 causes the valve member 33 to be pressed to return to its first switching position as shown in the figure.

In a second use example, if the transfer valve 11A is allowed to act as the internal pilot type and both the fourth and fifth ports 20 and 21 are connected to a supply source for pressurized fluid as a supply port, the transfer valve 11A can be used as an internal pilot and dual-end supply type. In this case, the first port 17 is used as an ejection port. A pilot fluid pushes open the check valves 38*b* and 38*c* corresponding to the fourth and fifth ports 20 and 21 and then enters the pilot supply channel 24.

While the solenoid is de-energized, the valve member 33 is in the first switching position as shown in the figure, the first port 17 (the ejection port) and the third port 19 (the output port) are in communication with each other, the second port 18 (the output port) and the fourth port 20 (the supply port) are in communication with each other, and the fifth port 21 (the supply port) is shut off. Here, pressurized fluid is output from the second port 18.

When the solenoid 14 is energized, the valve member 33 is moved to its second switching position, in which the first port 17 is allowed to communicate with the second port 18, the third port 19 is allowed to communicate with the fifth port 21, and the fourth port 20 is shut off. Here, pressurized fluid is output from the third port 19.

In a third use example, if external piping for supplying a pilot fluid is connected to the external pilot port X and the first port 17 is connected to a supply source for pressurized fluid in order to supply a pilot fluid under a pressure higher than that of a main fluid supplied to the first port 17 from the external piping to the external pilot port X, the transfer valve 11A can be used as an external pilot and central supply type. In this case, the pilot fluid from the external pilot port X is supplied to the return chamber 27 and the pilot supply port (p) through the check valve 38*d* and the pilot supply channel 24; however, the check valves 38*a*, 38*b*, and 38*c* prevent it from flowing back to the first, fourth, or fifth port 17, 20, or 21.

The external pilot and central supply type transfer valve in the third use example has substantially the same effects as the internal pilot and central supply transfer valve in the first use example except for the supply path of a pilot fluid, and so the description of the effects is omitted.

In a fourth use example, if the transfer valve 11A is allowed to operate as the external pilot type and both the fourth and fifth ports 20 and 21 are connected to a supply source for pressurized fluid as supply ports, the transfer valve 11A can be used as an external pilot and dual-end supply type. This transfer valve 11A has substantially the same effects as the internal pilot and dual-end supply type transfer valve according to the second embodiment except for the supply path for the pilot fluid, so a description of its effects is omitted.

Even if the supply of pilot fluid to the external pilot port X is stopped or the pressure of the pilot fluid decreases below that of the main fluid while the transfer valve 11A is being used as the external pilot type as in the third and the fourth use example, the transfer valve 11A automatically switches to the internal pilot type due to the operation of the individual check valves, then switches back to the external pilot type when the supply of a pilot fluid is resumed or the pressure increases.

Thus, the pilot 5-port transfer valve can be switched between the external pilot type and the internal pilot type by simply determining whether or not pilot fluid is being supplied through the external pilot port. Whether the external or the internal pilot type is selected, either central supply or dual-end supply can be selected by connecting either the first port 17 at the center or the fourth and fifth ports 20 and 21 at both ends, to a supply source for pressurized fluid.

As a result, the single transfer valve can be used as a plurality of types, so multiple transfer valves can be collectively mounted on a common manifold 80 for different uses as shown in FIG. 8.

In FIG. 8, the manifold 80 has sufficient length to accommodate a plurality (five in the illustrated example) of transfer valves; a supply channel 81 and ejection channels 82A and 82B for collectively supplying and ejecting pressurized fluid to and from each transfer valve, and a pilot channel 83 for supplying an external pilot fluid are formed in the manifold 80 in the longitudinal direction. These channels are opened in the top surface of the manifold in the positions on which transfer valves $\mathbf{11}A_1$, to $\mathbf{11}A_5$ are positioned, and communicate with the first port 17, the fourth port 20, the fifth port 21, and the pilot port X of the transfer valve when the transfer valve is directly positioned on the manifold. Output openings 84A and 84B individually in communication with the second and third ports 18 and 19 of each transfer valve are formed in the front surface of the manifold 80. The first to third transfer valves $\mathbf{11}A_1$, to $\mathbf{11}A_3$ within the five transfer valves are used as the central supply type in which they are directly positioned on the manifold 80 to allow the first port 17 to communicate with the supply channel 81 and in which the fourth and fifth ports 20 and 21 are in communication with the ejection ports 82A and 82B.

The fourth transfer valve $\mathbf{11}A_4$ is mounted on the manifold 80 via a channel changing plate 86 so that the first port 17 is shut off from the supply channel 81 in the manifold 80 and communicates with a second supply channel 87 formed in the plate 86, and so that a fluid under different pressure is supplied through the second supply channel 87. The connections with the other channels remain unchanged.

Furthermore, the fifth transfer valve 11$A_5$ is mounted on the manifold 80 via two channel changing plates 89 and 90 to change to dual-end supply. That is, the upper plate 89 shuts the first port 17 of the transfer valve 11$A_5$ off from the supply channel 81 in the manifold 80 while allowing the first port 17 to communicates with an ejection opening 92 in the plate 89, whereas the lower plate 90 shuts the fourth and the fifth ports 20 and 21 off from the ejection channels 82A and 82B in the manifold 80 while allowing these ports 20 and 21 to communicate with a supply opening 93 in the plate 90. The connections with the other channels remain unchanged.

Figure 3:
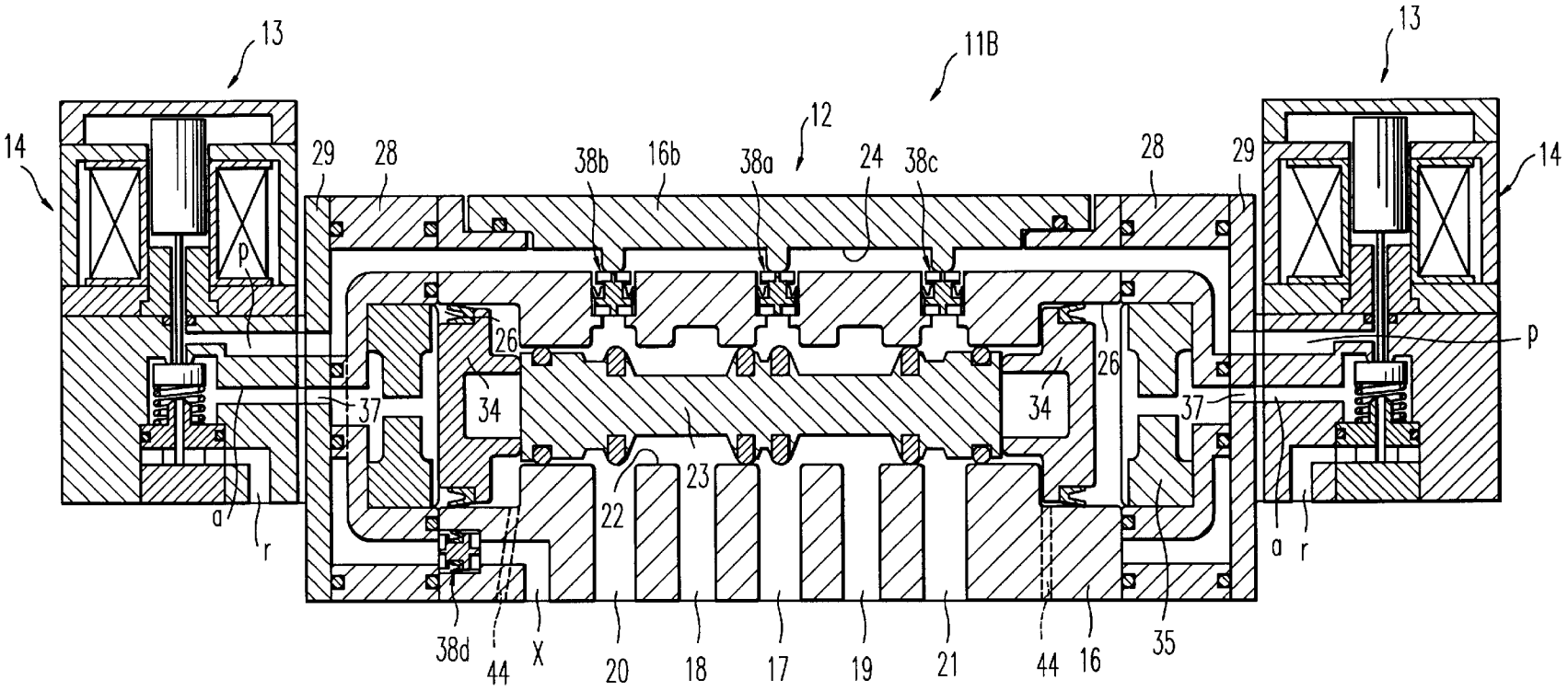
FIG. 3 is a cross sectional view showing a second embodiment of this invention.

FIG. 3 shows a second embodiment of this invention. A transfer valve 11B according to the second embodiment is of a double pilot 5-port type including two pilot valves 13 and 13. The second embodiment differs from the first embodiment in that it includes a pilot valve means instead of a returning means installed on one side of the valve member 33, as in the first embodiment. That is, this embodiment includes a piston chamber 26, a piston 34, a relay box 28, a cover 29, a cushion 35, a pilot valve 13, and a breather hole 44 instead of the return chamber 27, the return spring 32, and the presser cover 30 in the first embodiment.

The transfer valve 11B according to the second embodiment uses the pistons 34 and 34 to reciprocate the valve member 34 by alternatively turning the solenoids 14 and 14 for the two pilot valves 13 and 13 on and off to alternatively supply and eject a pilot fluid to and from the piston chambers 26 and 26. The other configuration and effects of this embodiment are substantially the same as in the first embodiment, so their description is omitted; instead, the same reference numerals are attached to the same main components.

Figure 4:
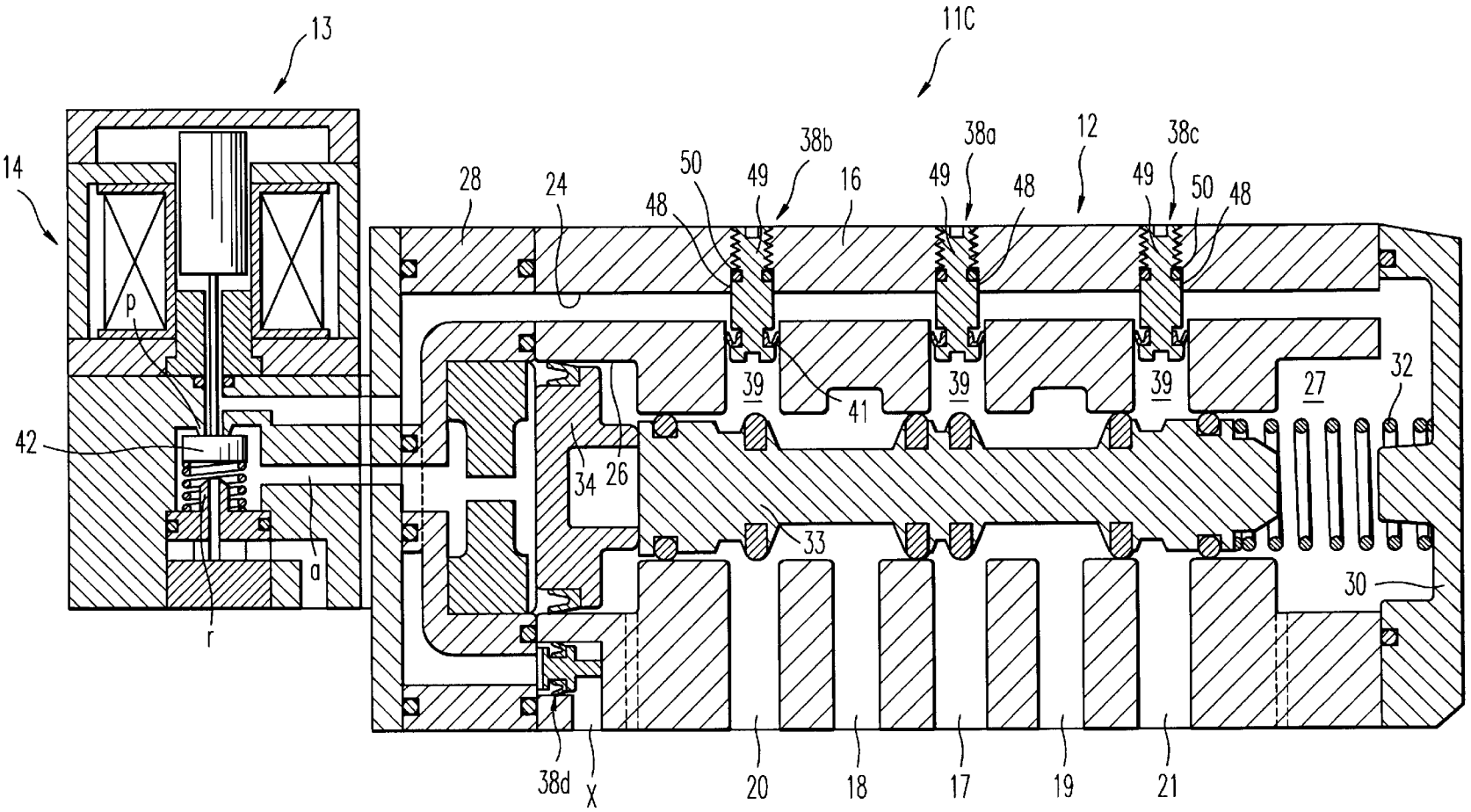
FIG. 4 is a cross sectional view showing a third embodiment of this invention.

FIG. 4 shows a third embodiment wherein a transfer valve 11C differs from the above embodiments in the structure of the check valves and the mounting thereof. The transfer valve 11C has in the top surface of the integral valve body 16 which does not have the top cover portion 16*b*, mounting holes 48 extending across the pilot supply channel 24 to the valve chamber 39; also, the check valves 38*a* to 38*c* are screwed into the mounting holes 48 from the top surface of the valve body 16.

The check valves 38*a* to 38*c* each have a valve body 49 with sufficient length to extend from the mounting hole 48 across the pilot supply channel 24 to the valve chamber 39. The valve body 49 has a lip seal 41 attached to its tip that is fitted to the valve chamber 39, and also has a thread fitting the mounting hole 48 and a seal ring 50 both provided in the mounting portion on its proximal side.

The other configuration and effects of the third embodiment are substantially the same as in the first embodiment, so their description is omitted; instead, the same reference numerals are attached to the same main components.

Although the third embodiment is a single pilot type transfer valve, it may of course be of a double pilot type.

Figure 5:
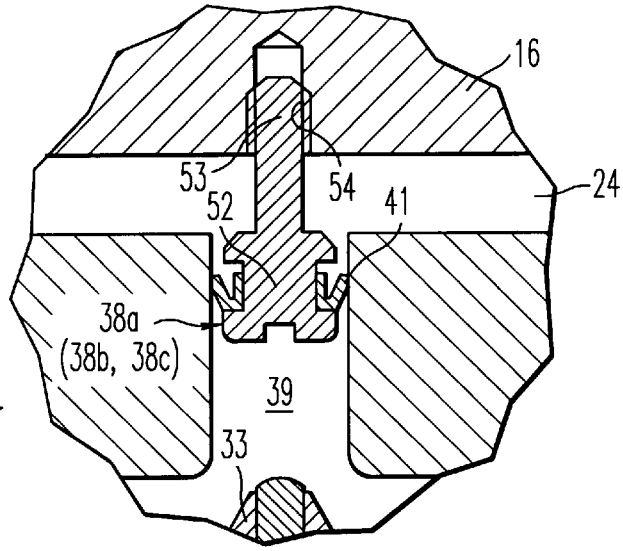
FIG. 5 is an enlarged cross sectional view of the integral part showing another example of the configuration of a check valve.

FIG. 5 shows a different example of the configuration of the check valves 38*a* to 38*c*. The check valves 38*a* to 38*c* each have a mounting portion 53 with a smaller diameter at the upper end of the valve body 52, and are mounted in the valve chamber 39 by screwing the mounting portion 53 into a mounting hole 54 in the body 16. In this case, if the body 16 is divided so as to have the upper cover portion 16*b* as in the first embodiment, the mounting hole 54 is formed in the upper cover portion 16*b* and the check valve is mounted in this hole. If the valve body is of an integral type that does not have the upper cover portion 16*b* as in the third embodiment, the mounting hole 54 is formed from the port side and the check valve is inserted into this hole 54 from the port side.

Figure 6:
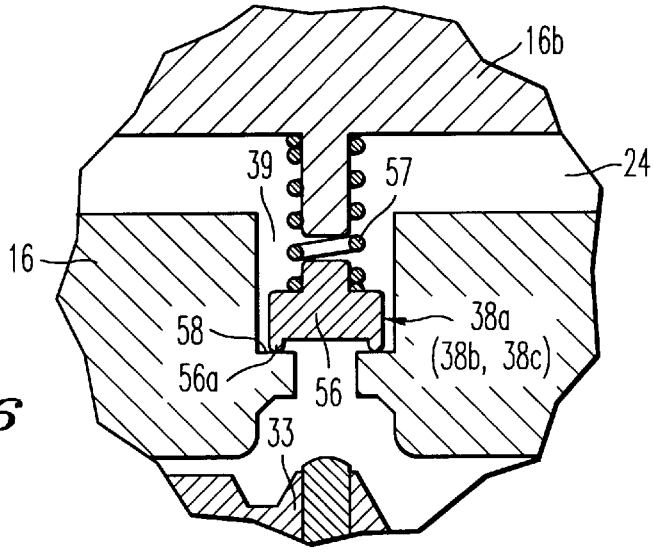
FIG. 6 is an enlarged cross sectional view of the integral part showing yet another example of the configuration of a check valve.

FIG. 6 shows another example of the configuration of the check valves 38*a* to 38*c*. These check valves 38*a* to 38*c* differ from the check valves according to the above embodiments in the use of a poppet valve member 56 instead of the directional lip seal 41 employed in the above embodiments. An annular seal portion 56*a* of the valve member 56 placed in the valve chamber 39, is contacted by a flat valve seat 58 provided between the port and the pilot supply channel 24, and the valve spring 57 contracted between the valve member 56 and the upper cover portion 16*b* is used to push the valve member 56 against the valve seat 58.

Figure 7:
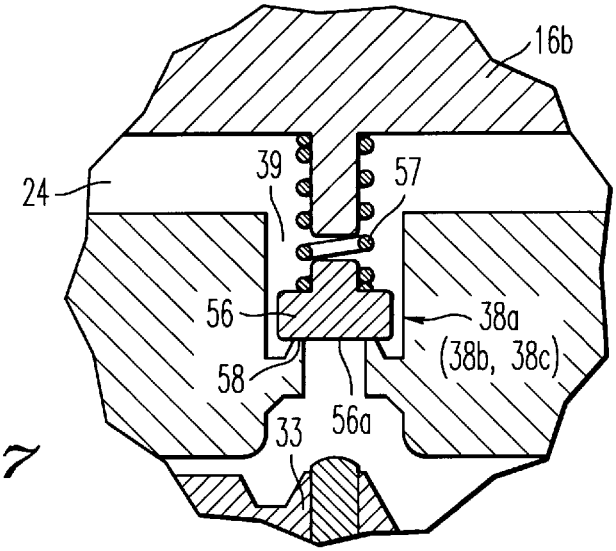
FIG. 7 is an enlarged cross sectional view of the integral part showing still another example of the configuration of a check valve.

FIG. 7 shows still another example of the configuration of the check valves 38*a* to 38*c*. The check valves 38*a* to 38*c* differ from those in FIG. 6 only in that the valve seat 58 is annular and that the seal portion 56*a* of the valve member 56 is flat.

Although not shown, the check valve 38*d* provided in the external pilot port X may be of a poppet type.

What is claimed is:

1. A pilot 5-port transfer valve comprising:

a first port for supplying and ejecting a pressurized fluid, a second and third ports for output, and a fourth and fifth ports for ejection and supply;

a valve member movably installed in a valve hole with which each of said ports communicates in order to switch connections among these ports;

at least one pilot valve for driving said valve member;

a pilot supply channel for supplying a pilot fluid to said at least one pilot valve;

check valves installed between said pilot supply channel and each of said first, fourth, and fifth ports to allow a pressurized fluid to flow from each port to the pilot supply channel while checking its flow in the opposite direction;

an external pilot port allowing a pilot fluid to be externally introduced; and a check valve installed between the external pilot port and said pilot supply channel to allow pilot fluid to flow from the pilot port to the pilot supply channel while checking its flow in the opposite direction.

2. A transfer valve according to claim 1 wherein each of said check valves comprises a valve body inserted into a valve chamber formed between each port and the pilot supply channel with a gap maintained for fluid communication; and an annular lip seal fitted on the outer circumference of the valve body to seal between the valve body and the inner wall of the valve chamber.

3. A transfer valve according to claim 2 wherein part of said pilot supply channel is defined and formed between the body and upper cover portions of the valve body of the transfer valve, wherein said check valve is installed in the part covered with the upper cover portion, and wherein the upper cover portion includes a protrusion that contacts the check valve to prevent it from slipping out from the valve chamber.

4. A transfer valve according to claim 2 wherein said check valve has a threaded mounting portion that screws the valve onto the valve body.

5. A transfer valve according to claim 1 wherein each of said check valves comprises a poppet valve member that contacts a valve seat formed between each port and the pilot supply channel, contacting from the side of the pilot supply channel; and a spring that pushes the valve member in the direction in which the member contacts the valve seat.

6. A transfer valve according to claim 1 wherein the check valve installed between said external pilot port and said pilot supply channel comprises a valve body inserted into a valve chamber formed between said external pilot port and said pilot supply channel with a gap maintained for fluid communication; and an annular lip seal fitted on the outer circumference of the valve body to seal between the valve body and the inner wall of the valve chamber.

7. A transfer valve according to claim 1 wherein the check valve installed between said external pilot port and said pilot supply channel comprises a poppet valve member that contacts a valve seat formed between said external pilot port and the pilot supply channel, contacting from the side of the pilot supply channel; and a spring that pushes the valve member in the direction in which the member contacts the valve seat.

* * * * *